US005671561A

United States Patent [19]

Johnson et al.

[11] Patent Number: 5,671,561

[45] Date of Patent: Sep. 30, 1997

[54] MODULAR, COMBINATION LASER AND ELECTRONIC AIMING SYSTEM

[75] Inventors: Acie G. Johnson, Pine Bluff; Glenn W. Prentice; W. Craig Burke, both of Little Rock, all of Ark.

[73] Assignee: Emerging Technologies, Inc., Little Rock, Ark.

[21] Appl. No.: 557,939

[22] Filed: Nov. 14, 1995

[51] Int. Cl.[6] ..... F41G 1/34

[52] U.S. Cl. ..... 42/103; 42/100; 42/101

[58] Field of Search ..... 42/103, 100, 101; 33/233, 241, 253; 362/110

[56] References Cited

U.S. PATENT DOCUMENTS

| | | | |
|---|---|---|---|
| 2,645,855 | 7/1953 | Ivy | 33/50 |
| 3,040,433 | 6/1962 | Heinzel | 33/50 |
| 3,823,313 | 7/1974 | Unema | 240/44.26 |
| 4,026,054 | 5/1977 | Snyder | 42/1 A |
| 4,161,076 | 7/1979 | Snyder | 42/1 A |
| 4,233,770 | 11/1980 | de Filippis et al. | 42/1 A |
| 4,295,289 | 10/1981 | Snyder | 42/1 A |
| 4,313,272 | 2/1982 | Matthews | 42/1 A |
| 4,688,345 | 8/1987 | Kilgour | 42/101 |
| 4,707,772 | 11/1987 | Jimenez et al. | 362/110 |
| 4,738,044 | 4/1988 | Osterhout | 42/103 |
| 4,940,324 | 7/1990 | Nichols | 356/247 |
| 5,033,219 | 7/1991 | Johnson et al. | 42/103 |
| 5,064,988 | 11/1991 | E'nama et al. | 219/121.6 |
| 5,134,798 | 8/1992 | Lee | 42/100 |
| 5,208,826 | 5/1993 | Kelley | 372/107 |
| 5,272,514 | 12/1993 | Dor | 356/251 |
| 5,355,608 | 10/1994 | Teetzel | 42/103 |
| 5,425,299 | 6/1995 | Teetzel | 89/14.4 |

FOREIGN PATENT DOCUMENTS 0998212 7/1965 United Kingdom .

OTHER PUBLICATIONS

Bushnell HOLOsight advertisement, Guns & Ammo, 1996.

*Primary Examiner*—Charles T. Jordan
*Assistant Examiner*—Meena Chelliah
*Attorney, Agent, or Firm*—Ray F. Cox, Jr.

[57] ABSTRACT

A modular, combination laser and electronic aiming system is disclosed having an electronic sight portion and a laser sight portion. The electronic sight portion has a lens and a first light source for projecting a light beam upon the lens. The laser sight portion has a second light source for projecting a beam onto a target. Separate frames may be used to mount the first and second light sources and the lens to the shooting apparatus, and the frame for the laser light source may be disposed between the frame for the electronic light source and the lens, securing the laser sight portion to the shooting apparatus without interfering with the operation of the electronic sight portion.

13 Claims, 1 Drawing Sheet

MODULAR, COMBINATION LASER AND ELECTRONIC AIMING SYSTEM

BACKGROUND OF THE INVENTION

This invention relates to aiming devices and, more particularly, to weapon sights.

Laser sights for weapons are well known and permit a user to aim a weapon by projecting a light beam onto a target. Laser sights offer many advantages over other conventional sights and are useful in any number of situations. For example, laser sights permit a user to quickly aim a weapon without viewing the target through a scope or other sighting device. This also permits the user to aim and shoot from any number of other firing positions, such as permitting the user to shoot from the hip. If the laser sight is properly sighted for the distance and wind conditions involved, a projectile, such as a bullet, arrow or shot, from a weapon will strike the desired target where the light dot generated by the laser sight shines on the target.

Laser sights are not, however, without problems. For example, although laser sights work well in low light conditions, in bright light conditions laser sights occasionally perform poorly because ambient light can easily overwhelm the dot generated on the target by the laser light source, making the dot difficult or impossible for the user to see. A laser sight also uses a relatively large amount of power, so the battery life for a laser sight is typically relatively short. Also, as with other sights, a laser sight is adjusted or sighted for a particular distance and wind condition. Although a laser sight can be adjusted for different distances, these adjustments are time consuming and require firing several rounds, so it is typically inconvenient or impractical to adjust the sight for different distances when the user is in the field hunting.

Electronic sights for weapons are also well known in the art. Electronic sights use a light source to project a narrow beam of light onto a specially coated lens. The lens reflects the light to the eye of the user, and the user sees the light as a small, colored dot on the lens. The user aims the weapon by viewing the target through the lens and positioning the dot on the target. If the electronic sight is properly zeroed or sighted for the distance and wind conditions involved, a projectile from the weapon will strike the target at the position on the target covered by the dot on the lens. Electronic sights offer many advantages over conventional sights in any number of firing situations. For example, typical telescopic sights require a user's eye to be carefully aligned behind the scope and require a particular eye relief, requiring the user's eye to be a particular distance from the scope lens, typically around three inches. This makes scopes difficult to aim quickly, difficult to use while tracking a moving target and difficult or impossible to use with weapons such as pistols or bows. Electronic sights overcome these problems in that they do not require any particular eye relief and do not require, relatively speaking, the careful alignment of the user's eye relative to the lens. If the user can see the light dot reflected from the lens, the user can aim the weapon, and a projectile fired from a properly sighted weapon will strike the target at the point on the target covered by the light dot on the lens, regardless of the alignment of the user's eye relative to the lens.

Electronic sights are also not without problems. For example, electronic sights still require a user to view a target through a lens and, therefore, do not offer the aiming flexibility discussed above in connection with laser sights. As with a laser and other sight, an electronic sight is zeroed or sighted for a particular distance, and adjustments in the field are also typically inconvenient or impractical.

SUMMARY OF THE INVENTION

It is therefore an object of the present invention to provide an aiming system that provides a user with the advantages of both laser and electronic sights.

It is a further object of the present invention to provide a system of the above type that is compact, lightweight and provides for ease of manufacture.

It is a still further object of the present invention to provide a system of the above type that may be easily mounted on a wide variety of shooting instruments including, but not limited to, rifles, muzzleloaders, shotguns, pistols, bows, compound bows and crossbows.

It is a still further object of the present invention to provide a system of the above type which provides for improved stability in mounting.

It is a still further object of the present invention to provide a system of the above type which may be sighted for two different distances.

Toward the fulfillment of these and other objects and advantages, the modular aiming system of the present invention comprises a combination sight having an electronic sight portion and a laser sight portion. The electronic sight portion has a lens and a first light source for projecting a light beam upon the lens. The laser sight portion has a second light source for projecting a beam onto a target. Separate frames may be used to mount the first and second light sources and the lens to the shooting apparatus, and the frame for the laser light source may be disposed between the frame for the electronic light source and the lens, securing the laser sight portion to the shooting apparatus without interfering with the operation of the electronic sight portion.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
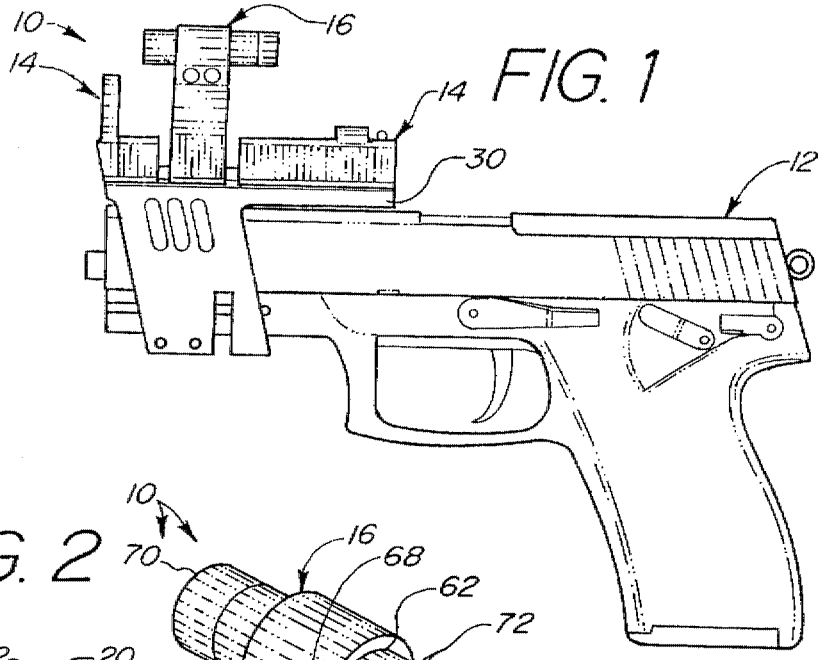
FIG. 1 is an elevation view of a handgun with an alternate embodiment of an aiming system of the present invention.
Figure 2:
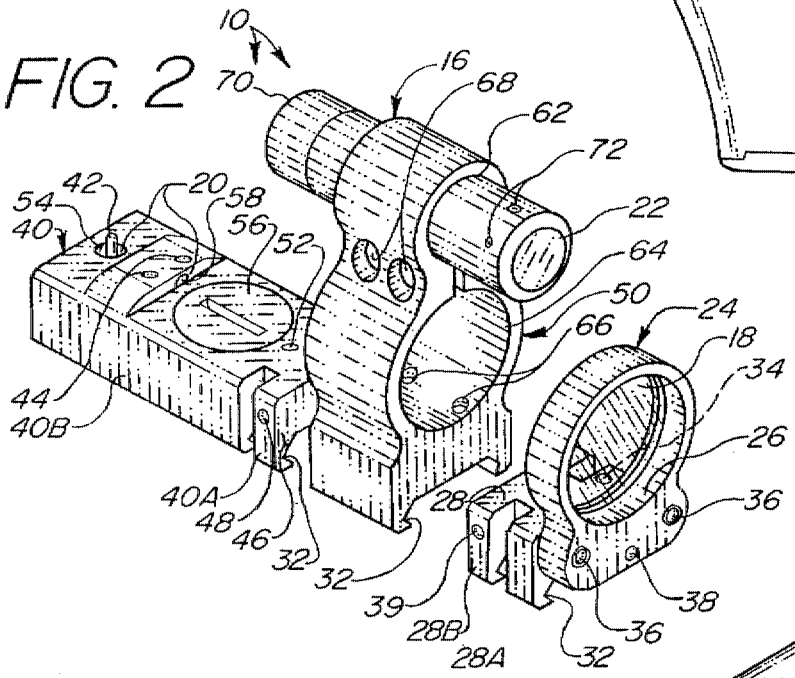
FIG. 2 is an elevation view of an aiming system of the present invention.

Referring to FIG. 1, the reference numeral 10 refers in general to an alternate embodiment of an aiming system of the present invention mounted on a shooting apparatus 12. As best shown in FIG. 2, the aiming system 10 of the present invention has an electronic sight portion 14 and a laser sight portion 16. The electronic sight portion 14 has a lens 18 and a first light source 20, and the laser sight portion has a second light source 22.

The lens 18 is mounted in a frame 24 having an upper portion 26 which receives and retains the lens 18 and a lower portion 28 adapted for mounting on a shooting apparatus 12, either directly to the shooting apparatus 12 or using a mounting rail or bar 30. The lens is specially coated to reflect light within a desired range of wavelengths, and the wavelength of the first light source 20 preferably falls within this range. In this regard, the preferred embodiment has dovetail channeling 32 for mounting on a dovetail mount, such as a standard Weaver dovetail mount.

The lower frame portion 28 has a first, front frame portion 28A and a second, rear frame portion 28B. The first, front frame portion 28A has mounting screws 34. In upper portion 26, screws 36, 38 permit movement of the upper frame portion 26 and lens 18 relative to the lower frame portion 28, thereby permitting windage and elevation adjustments, respectively, of the electronic sight portion 14. The rear frame portion 28B has oposing legs 37. Screws 39 pass through the legs 37 for moving the legs 37 toward and away from each other as desired.

Frame 40 houses the first, electronic light source 20, preferably a light-emitting diode or LED light source that provides a noncoherent light beam. The light source 20 has a printed circuit board, an LED, a power source, such as a button cell battery, and a switch 42 that may be toggled between off, low and high settings. The LED light source 20 is highly energy efficient and may be operated for many hours on a single battery. The light source 20 is inserted into the frame 40 from the bottom and screws 44 secure the light source 20 to the frame 40. A lower portion of the frame 40 is adapted for mounting on a shooting apparatus, such as using dovetail channeling 32 to mount the frame and light source 20 on a standard Weaver dovetail, or similar, mount.

Figure 3:
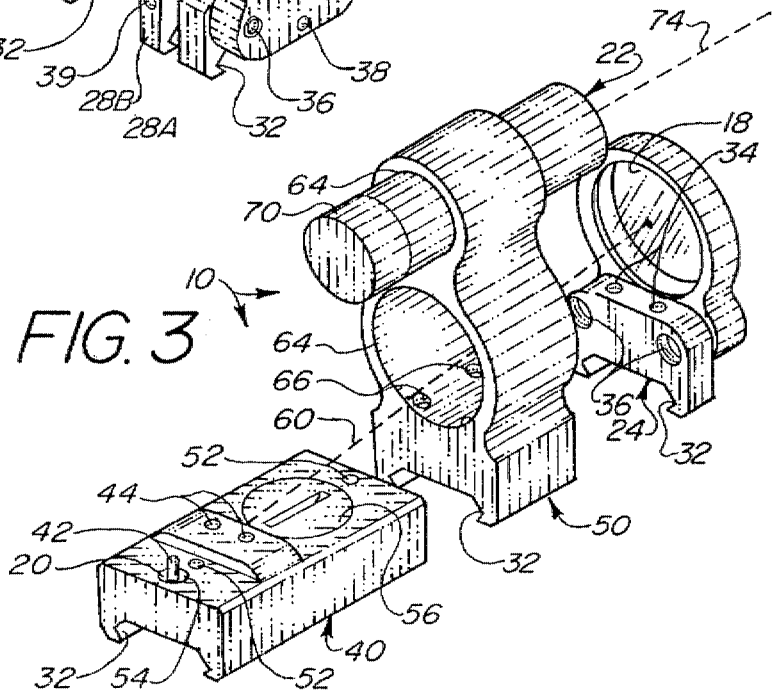
FIG. 3 is an elevation view of an alternate embodiment of an aiming system of the present invention.

The frame 40 has front 40A and rear 40B portions, and the front portion 40A has opposing legs 46. Screw 48 pass through the legs 46 for moving the legs 46 toward and away from each other as desired. FIG. 2 shows opposing legs 46 as used in the preferred embodiment, and FIGS. 1 and 3 depict an alternate embodiment in which the legs are not used. As shown in FIG. 2, for compactness, opposing legs 46 preferably extend toward frame 50. The rear portion 40B has mounting screws 52, an opening 54 for the switch 42, a removable cap 56 to provide access to the power source or battery and a pinhole 58 passing through a raised portion for directing a narrow light beam 60 from the light source 20 to the lens 18. Frames 24, 40 and 50 are preferably made from aircraft aluminum for strength and lightweight construction, although it is understood that any number of suitable materials may be used.

Frame 50 has a generally figure eight shape forming upper 62 and lower 64 apertures and has dovetail channeling 32 along a lower portion thereof. The upper aperture 62 is sized to receive and retain a second light source 22, such as a laser light source, and the lower aperture 64 is sized to avoid interfering with operation of the electronic sight portion 14 when the frame 50 is positioned between the first light source 20 and the lens 18. Screws 66 secure the frame to a shooting apparatus or to a mounting rail which is in turn secured to a shooting apparatus. Screws 68 are used to tighten or loosen aperture 62 about the light source 22.

The second light source 22 is preferably a solid state laser light source using a laser diode but may be any conventional laser light source, such as a gas laser. The light source 22 has a rear portion 70 that is rotatable relative to the front portion for switching the light source 22 on and off. The rear portion 70 is also removable to provide access for battery replacement. The switching may also be by a momentary switch connected by wire to a remote location.

The aiming system 10 may be secured directly to a shooting apparatus 12 or, if the shooting apparatus does not have a suitable integral mount, may be secured to a mounting rail or bar 30, such as shown in FIG. 1. The term "shooting apparatus" is used broadly herein to refer to any conventional shooting device including, but not limited to, rifles, muzzleloaders, shotguns, pistols or handguns, bows, compound bows and crossbows.

In operation, the frame 40 is slid onto a mount, such as a standard Weaver dovetail mount, of a shooting apparatus 12 and secured in place using screws 52 so that the front frame portion 40A extends toward the firing end of the shooting apparatus 12, for compactness. Screws 52 raise the frame 40 relative to the mount, thereby biasing the dovetail channeling 32 of the frame 40 against the dovetail mount. Screw 48 is tightened to move opposing legs 46 inwardly to clamp opposing legs 46 against opposite sides of the dovetail mount for added lateral stability. Laser light source 22 is placed within aperture 62 and screws 68 are tightened to clamp the laser light source 62 in place within the upper aperture 62. The frame 50 is then slid onto the mount with the laser light source 22 directed toward the firing end of the shooting apparatus 12, and screws 66 are tightened to secure the frame to the mount.

Frame 24 is then slid onto the mount so that the upper portion 26 is positioned toward the firing end of the shooting apparatus 12, for compactness, and the frame 24 is carefully positioned so that the lens 18 is a desired distance from the light source 20. Screws 34 and 37 are then tightened to secure the frame 24 to the mount.

The laser sight portion 16 and electronic sight portion 14 are then zeroed or sighted for desired distances in the usual manner. Screws 72 are used to zero the laser sight portion 22, and screws 36 and 38 are used to zero the electronic sight portion. The laser and electronic sight portions 16 and 14 may be zeroed or sighted for different distances, preferably with the laser sight being used for the shorter distance.

The electronic and laser sight portions are preferably used independently of each other. If the user wishes to use the laser sight portion 16, the user rotates the switch 70 to turn the laser sight portion on and aims the weapon by projecting a light beam 74 generated by the laser light source onto a target to produce a light dot on the target. Because of the specially coated lens 18, the dot on the target may not be visible through the lens 18, so the user aims the laser sight portion 16 without viewing the target through the lens 18.

If the user wishes to use the electronic sight portion 14, the user activates the switch 42 to turn the sight on to the desired setting and views the target through the lens 18, positioning the dot generated on the lens 18 by the LED light source 20 over the target. Because the dot generated on the target by the laser sight 16 may not be visible through the lens 18, the laser dot should not confuse the user or cause problems when viewing the target through the lens 18. The electronic sight portion 14 may therefore be used without turning off the laser light portion 16.

Other modifications, changes and substitutions are intended in the foregoing, and in some instances, some features of the invention will be employed without a corresponding use of other features. For example, although the preferred embodiment is described as being modular, using separate frames 24, 40 and 50 to mount separate components of the system, it is understood that the system may be housed within a single frame or housing. Also, although the frame 50 is described and depicted as being positioned between the frame 40 and lens 18, it is understood that the various frames and components may be arranged in any number of configurations, such as positioning the frame 50 behind the frame 40 or in front of the lens 18. Further, although the preferred embodiment is described as having opposing wings or legs 37 and 46, it is understood that the system may be used with or without these opposing legs. Further still, although the aiming system is described for use in connection with a weapon or shooting apparatus 12, it is understood that the aiming system may be useful in other areas. Accordingly, it is appropriate that the appended claims be construed broadly and in a manner consistent with the scope of the invention.

What is claimed is:

1. A weapon comprising:

a shooting apparatus that has a barrel; and a combination sight, comprising:

an electronic sight portion mounted on said shooting apparatus and disposed above said barrel, said electronic sight portion comprising:

a lens mounted on said shooting apparatus;

a first frame mounted on said shooting apparatus; and a first light source, said first light source being secured to said first frame and being mounted on said shooting apparatus at a desired distance from said lens; and a laser sight portion mounted on said shooting apparatus and disposed above said barrel, said laser sight portion comprising:

a second frame mounted on said shooting apparatus between said first frame and said lens; and a second light source, said second light source being secured to said second frame and mounted on said shooting apparatus in a position to avoid interfering with operation of said electronic sight portion.

2. The weapon of claim 1 wherein said second frame has an upper aperture for receiving and retaining said second light source and a lower aperture to avoid interfering with operation of said electronic sight portion.

3. A weapon comprising:

a shooting apparatus; and a combination sight, comprising:

an electronic sight portion mounted on said shooting apparatus, said electronic sight portion comprising:

a lens mounted on said shooting apparatus;

a second frame for securing said lens to said shooting apparatus, said second frame comprising:

an upper frame portion adapted to receive and retain said lens;

a lower frame portion adapted to mount said second frame on said shooting apparatus; and means for securing said upper frame portion to said lower frame portion so that said upper frame portion and said lens may be moved relative to said lower frame portion to permit windage and elevation adjustments of said electronic sight portion; and a first frame mounted on said shooting apparatus; and a first light source, said first light source being secured to said first frame and being mounted on said shooting apparatus at a desired distance from said lens; and a laser sight portion mounted on said shooting apparatus.

4. The weapon of claim 3 wherein said lower frame portion of said second frame comprises:

a first frame portion having dovetail channeling along a lower portion thereof;

a screw passing through said first frame portion for raising said second frame relative to said shooting apparatus, thereby biasing said dovetail channeling against a dovetail mount of said shooting apparatus;

a second frame portion having opposing legs; and a means for biasing said opposing legs inwardly to clamp said opposing legs against opposing sides of said dovetail mount for added stability.

5. A weapon comprising:

a shooting apparatus; and a combination sight, comprising:

an electronic sight portion mounted on said shooting apparatus, said electronic sight portion comprising:

a lens mounted on said shooting apparatus;

a first frame mounted on said shooting apparatus; and a first light source, said first light source being secured to said first frame and being mounted on said shooting apparatus at a desired distance from said lens; and a laser sight portion mounted on said shooting apparatus, said laser sight portion having a separate power source than said electronic sight portion, and said laser sight portion comprising:

a second frame mounted on said shooting apparatus; and a second light source, said second light source being secured to said second frame and mounted on said shooting apparatus in a position to avoid interfering with operation of said electronic sight portion.

6. A weapon comprising:

a pistol;

a dovetail rail affixed to said pistol and extending above and substantially parallel to a barrel of said pistol; and a combination sight, comprising:

an electronic sight portion mounted on said dovetail rail, said electronic sight portion comprising:

a lens mounted on said dovetail rail;

a first frame mounted on said dovetail rail; and a first light source, said first light source being secured to said first frame and being mounted on said dovetail rail at a desired distance from said lens; and a laser sight portion mounted on said dovetail rail, said laser sight portion comprising:

a second frame mounted on said dovetail rail between said first frame and said lens; and a second light source, said second light source being secured to said second frame and mounted on said dovetail rail in a position to avoid interfering with operation of said electronic sight portion.

7. A combination weapon aiming device, comprising:

an electronic sight portion adapted for mounting on a dovetail mount, said electronic sight portion comprising:

a lens;

a first frame; and a first light source secured to said first frame; and a laser sight portion adapted for mounting on said dovetail mount, said laser sight portion comprising:

a second frame; and a second light source secured to said second frame, said second frame being adapted so that said second frame may be positioned between said lens and said first frame without interfering with operation of said electronic sight portion.

8. The device of claim 7 wherein said second frame has an upper aperture for receiving and retaining said second light source and a lower aperture for permitting said second frame to be positioned between said lens and said first frame without interfering with operation of said electronic sight portion.

9. A combination weapon aiming device, comprising:

an electronic sight portion adapted for mounting on a dovetail mount, said electronic sight portion comprising:

a lens;

a first frame, said first frame comprising:

a rear frame portion having dovetail channeling along a lower portion thereof;

a screw passing through said rear frame portion for raising said first frame relative to said dovetail mount, thereby biasing said dovetail channeling against said dovetail mount;

a front frame portion having opposing legs; and means for biasing said opposing legs inwardly to clamp said opposing legs against opposing sides of said dovetail mount for added lateral stability; and a first light source secured to said first frame; and a laser sight portion adapted for mounting on said dovetail mount.

10. A modular aiming device comprising:

first, second and third frames;

a first light source secured to said first frame;

a second light source secured to said second frame;

a lens secured to said third frame; and a rail; said first, second and third frames being secured to said rail in a desired alignment so that said first light source may project a first light beam onto said lens and said second light source may project a second light beam onto a target.

11. The device of claim 10 wherein said first light source is an LED light source and said second light source is a laser light source.

12. The device of claim 11 wherein said first light source and said second light source have separate power sources.

13. The modular aiming device of claim 12 wherein second frame has an upper aperture for receiving and retaining said second light source and a lower aperture for permitting said first light beam to pass from said first light source to said lens.

* * * * *